US006984266B2

(12) United States Patent
Buchholzer

(10) Patent No.: US 6,984,266 B2
(45) Date of Patent: Jan. 10, 2006

(54) FIBER PREPARATION SYSTEM

(75) Inventor: Paul Buchholzer, Schwulper (DE)

(73) Assignee: Fraunhofer-Gesellschaft zur Förderung der angewandten Forschung e.V., Munich (DE)

( * ) Notice: Subject to any disclaimer, the term of this patent is extended or adjusted under 35 U.S.C. 154(b) by 163 days.

(21) Appl. No.: 10/432,958

(22) PCT Filed: Oct. 26, 2001

(86) PCT No.: PCT/DE01/04071

§ 371 (c)(1),
(2), (4) Date: Nov. 28, 2003

(87) PCT Pub. No.: WO02/43934

PCT Pub. Date: Jun. 6, 2002

(65) Prior Publication Data

US 2004/0065758 A1 Apr. 8, 2004

(30) Foreign Application Priority Data

Dec. 1, 2000 (DE) ..... 100 59 881

(51) Int. Cl.
*B05C 5/02* (2006.01)

(52) U.S. Cl. ..... 118/303; 118/313; 118/315

(58) Field of Classification Search ..... 118/303, 118/313, 315; 156/296; 264/134, 136, 137; 425/104, 90; 427/212, 213; 162/185
See application file for complete search history.

(56) References Cited

U.S. PATENT DOCUMENTS 3,974,307 A * 8/1976 Bowen ..... 427/212
5,792,264 A * 8/1998 Frati ..... 118/303

FOREIGN PATENT DOCUMENTS

| | | | |
|---|---|---|---|
| DE | 3839671 | A1 | 5/1990 |
| DE | 199 30 800 | A1 | 2/2000 |
| DE | WO 00/07785 | | 2/2000 |
| EP | 0 728 562 | A2 | 8/1996 |
| EP | 1022 103 | A2 | 7/2000 |
| FR | 75 05890 | | 2/1975 |
| JP | 2001018206 | A | 1/2001 |

* cited by examiner

*Primary Examiner*—Laura Edwards
(74) *Attorney, Agent, or Firm*—Whitham, Curtis & Christofferson, PC

(57) ABSTRACT

The invention relates to a system for producing and preparing fibers. The system provides a first separator that is connected downstream of a tubular dryer, a fiber outlet of said separator being connected to a second separator by a connecting conduit. A size application device (9), formed by a section of conduit containing an internal tube (14) that is provided with air passages (13) and has a greater flow cross-section than the connecting conduit, is integrated into said connecting conduit. The internal tube is surrounded by an external tube (15), which together with the internal tube defines an annular chamber that has at least one compressed air connection (20).

10 Claims, 1 Drawing Sheet

FIBER PREPARATION SYSTEM

The invention relates to a system for the production and preparation of fibers prior to their hot-pressing to form fiberboards, with a refiner for the milling of, in particular, chips to form fibers which then pass by steam or air pressure through a blow line, a tubular dryer, a first separator, a sizing device and a second separator into a fiber bunker preceding a spreading machine or directly into a spreading machine, the sizing device being integrated into a connecting pipeline to the second separator and comprising a size wetting zone which extends over a portion of this connecting pipeline and comprises a cylindrical inner pipe which is provided with air passage orifices and has size nozzles projecting into it and a flow cross section enlarged with respect to the connecting pipeline and which is surrounded by an outer pipe which, with the inner pipe, encloses an interspace having at least one air connection.

The above-described system may be gathered from EP 1 022 103 A2. Here, the fiber outlet of the first separator is led into a bunker balance, from which the fibers then pass via said connecting pipeline through the sizing device connected into the latter and via a blower following this sizing device into the second separator, from which the transport air is suction-extracted via a blower, conducted via a filter, heating in a heating device and then injected through the air passage orifices of the inner pipe into the size wetting zone. The flow cross section of the inner pipe increases continuously from the entrance of the connecting pipeline to the exit, the air being injected via four air distributor lines arranged so as to be distributed over the outer circumference of the outer pipe, via individual pipes connected one behind the other in the longitudinal direction of the size wetting zone and arranged so as to be inclined in the conveying direction of the fibers.

DE 199 30 800 A1 discloses a system, in which the end portion of the tubular dryer is designed as a size wetting zone, in which, by the flow cross section of the tubular dryer being increased, the transport speed of the fiber mixture is reduced and a turbulent flow is thereby generated. This turbulence is further increased by the injection of additional air which, simultaneously with the injection of the binder, is injected together with the latter axially into the center of the wetting zone. The length of the wetting zone is about five to ten times greater than its diameter. In this previously known method, the transport speed of the fiber mixture in the size wetting zone is reduced by about 100% to 300% in relation to the transport speed in the dryer zone. The moisture of the fiber mixture is reduced, as a result of the drying, to preferably 2% to 10%, so that the final moisture of the size/fiber mixture is preferably 8–12%.

EP 0 728 562 A2 discloses a method and an apparatus for the wetting of pneumatically conveyed particles with a fluid. In this case, the fluid is sprayed by means of nozzles into a conveying line through which the particles flow. In order to ensure uniform and fine wetting, there is provision for the nozzles to be arranged in a region of the conveying line which has a diffusor-like cross-sectional widening. The wetting zone is formed by a portion of the horizontally running conveying line, there being provision for the particles to run through a dryer device before reaching the wetting zone. Here, too, an attempt is made efficiently and uniformly to size the already dried fibers, which tend particularly to form lumps or bundles, in the air stream. On account of the problematic formation of bundles which lead to size spots in the fiberboard surfaces, it had previously been recommended to carry out the sizing with moist fibers which then subsequently had to be dried. However, fiber drying after sizing has the major disadvantage of an increased size consumption, the cause of which it has not yet been possible to explain fully.

But what is common to all the previously known systems is the problem of the adhesion of the fibers just sprayed with size to the pipe inner wall of the size wetting zone. In order to prevent an excessive reduction of the free flow cross section in the wetting zone or even a clogging of the pipe cross section, said pipe inner wall has to be cleaned from time to time. This not only requires a stoppage of the system, but is highly labor-intensive, because the pipe portion forming the size wetting zone is usually placed at a great height in the production room and is therefore accessible only with difficulty. Moreover, the fibers adhering to the pipe inner wall are the cause of the disturbing size spots which occur in the fiberboard surface and which are due to fiber lumps or the like coming loose from the pipe inner wall again.

The object on which the invention is based is, therefore, to improve the system initially described, in such a way that fiberboards free of size spots and having low metered binder quantities can be produced efficiently.

Proceeding from the system described initially, this object is achieved, according to the invention, by means of the following additional features:

a) the fiber outlet of the first separator is connected to the second separator via said connecting pipeline, into which a blower is connected upstream of the sizing device;
b) the inner pipe is designed cylindrically, the increase in its flow cross section taking place upstream of the size wetting zone and a reduction in its flow cross section taking place downstream of the size wetting zone from and to the initial diameter of the connecting pipeline respectively, in each case via an annular cone;
c) the upstream annular cone, which, like the downstream annular cone, is provided with air passage orifices, is surrounded by a ring with controlled automatic injection devices, the size nozzles of which project through the upstream annular cone into the inner pipe; and
d) the outer pipe concentrically surrounds the inner pipe and with the latter defines an annular space which is sealed off at its two ends and which has at least one compressed-air connection, from which compressed air is fed into the annular space via annular compressed-air distributors concentrically surrounding the outer pipe; and
e) the air passage orifices of the inner pipe have a diameter of about 0.1–0.5 mm.

The moisture of the fibers immediately after their drying is of the order of magnitude of about 20%, which may lead to various disadvantages during the sizing. The sizing is therefore to take place only downstream of a separator following the dryer; the moisture of the fibers before their sizing is then only about 6%.

According to the invention, the transport speed of the fiber mixture through the upstream annular cone is to be reduced over a short flow distance, in order thereby to generate a turbulent flow into which the size is injected. The size nozzles therefore project through the upstream annular cone, through which, moreover, compressed air is injected, in order, particularly in this region, to prevent an accretion or sticking of fibers.

In order to ensure in the second separator a sufficiently high air inlet velocity which is necessary for accurate separation, according to the invention a downstream annular cone is provided, by means of which the flow cross section of the inner pipe is reduced again to the size of its entrance. So that the dynamic pressure occurring at the downstream annular cone does not lead to an accretion or sticking of the fibers on the pipe inner wall, according to the invention air passage orifices are also provided in the downstream annular cone.

In order, in the sizing zone, to protect the pipe inner wall effectively against contamination by accreting or sticking fibers, it is advantageous if the air passage orifices of the inner pipe have a diameter of about 0.1 to 0.5 mm and if the fed-in compressed air has a pressure of approximately 2 bar. In this case, to restrict the consumption of compressed air, it is advantageous if the distance between the air passage orifices is about 2 cm.

A uniform sprinkling of the fibers, in conjunction with a binder injection which protects the pipe inner wall of the sizing zone, is ensured when the size nozzles form an angle of about 60° with the longitudinal center axis of the size wetting zone. In this case, it is advantageous if the size nozzles are flat-jet nozzles with a maximum injection angle of about 90°.

Further features of the invention are the subject matter of the subclaims and are explained in more detail, together with further advantages of the invention, by means of an exemplary embodiment.

The following table lists the properties of various fiberboards produced, free of size spots, on a laboratory installation, metered binder quantities of 4.50 (A/B/C/), 5.75 (D/E/F) and 7.00 (G/H/I) % solid resin/ABS dry fiber having been set.

| Property | Symbol | Board | A/B/C | D/E/F | G/H/I | MDF | MDF/LA |
|---|---|---|---|---|---|---|---|
| Bulk density | $kg/m^3$ | | 749 | 750 | 756 | — | — |
| Binder content | % SR/ABS | wood | 4.50 | 5.75 | 7.00 | — | — |
| Bending strength | $N/mm^2$ | | 23.2 | 26.8 | 31.0 | 20 | 25 |
| Modulus of bending elasticity | $N/mm^2$ | | 3134 | 3051 | 3253 | 2200 | 2500 |
| Transverse tensile strength | $N/mm^2$ | | 0.31 | 0.52 | 0.69 | 0.55 | 0.60 |
| Thickness swelling $q^{24}$ | % | | 20.1 | 14.8 | 12.0 | 12 | 12 |
| Formaldehyde content | mg HCHO/ 100 g a. Fl. | | 7.4 | 7.7 | 7.2 | 8 | 8 |

An embodiment of the invention which serves as an example is illustrated diagrammatically in the drawing, in which.

Figure 1:
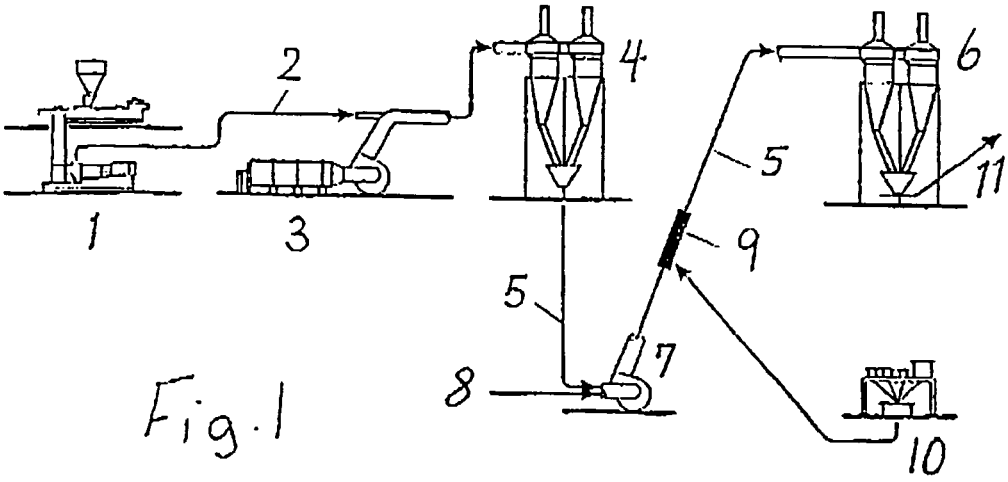
FIG. 1 shows a basic diagram of a fiber preparation system.

FIG. 1 shows the essential components of a system for the production and preparation of fibers prior to their hot-pressing to form fiberboards. A refiner 1 is provided for the milling of, in particular, chips to form fibers which are then fed by steam or air pressure through a blow line 2 into a tubular dryer 3 followed by a first separator 4, the fiber outlet of which is connected to a second separator 6 via a connecting pipeline 5.

A blower 7, which has an intake connection piece for conditioned air 8, is connected into this connecting pipeline 5.

Integrated in a steeply upward-running portion of the connecting pipeline 5 is a sizing device 9 which is supplied via a binder supply device 10 with binder for sprinkling the fibers conveyed through the connecting pipeline 5. The steep line run reduces the risk of the fibers settling on the pipeline inner wall.

The sized fibers 11 emerging from the second separator 6 pass into a fiber bunker, not illustrated in any more detail in the drawing, preceding a spreading machine, likewise not illustrated in any more detail, or else directly into a spreading machine.

Figure 2:
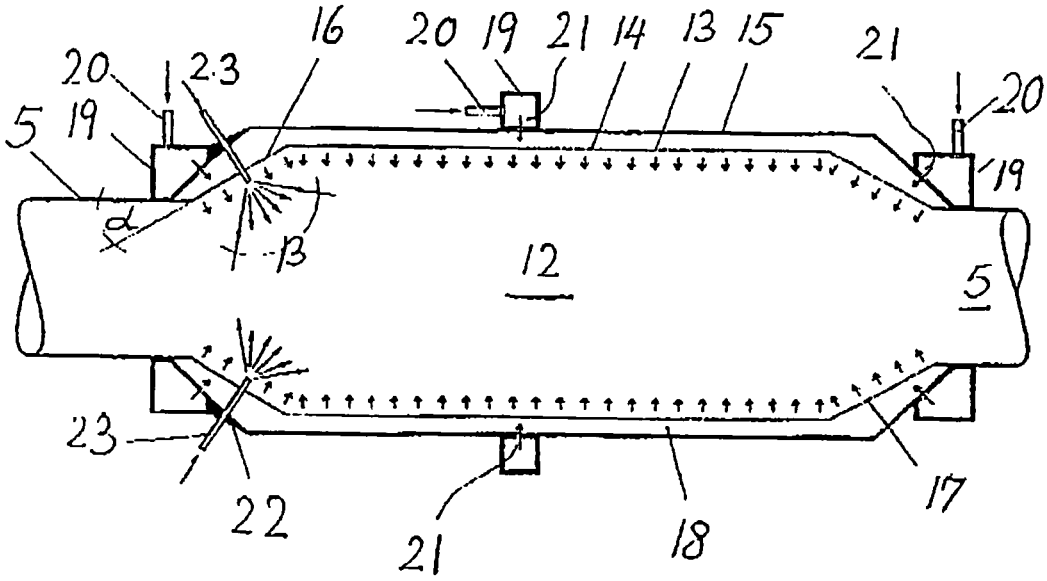
FIG. 2 shows, on an enlarged scale, a longitudinal section through the sizing device indicated in FIG. 1.

According to FIG. 2, the sizing device 9 comprises a size wetting zone 12 extending over a portion of the connecting pipeline 5 which, in turn, comprises a cylindrical inner pipe 14 which is provided with air passage orifices 13 and has a flow cross section enlarged in relation to the connecting pipeline 5 and which is surrounded concentrically by an outer pipe 15.

The length of the size wetting zone 12 corresponds approximately to 5 to 10 times the pipeline diameter. The flow cross section of the inner pipe 14 is about 20%–80% larger than that of the connecting pipeline 5. In this case, the increase in the flow cross section takes place upstream of the size wetting zone 12 and the reduction in the flow cross section takes place downstream of the size wetting zone 12 from and to the initial diameter of the connecting pipeline 5 respectively, in each case via an annular cone 16, 17 which is likewise provided with air passage orifices 13.

The outer pipe 15 defines, together with the inner pipe 14, an annular space 18 which is sealed off at its two ends and into which compressed air with a pressure of preferably about 2 bar can be injected. This compressed-air feed into the annular space 18 takes place via annular compressed-air distributors 19 which concentrically surround the outer pipe 15 and which are arranged at the start of the size wetting zone 12, at about half the length of the latter, and at the end of the size wetting zone 12, in each case have a compressed-air connection 20 and are provided with a plurality of compressed-air injection orifices 21 which are arranged so as to be distributed over their circumference and are connected to the annular space 18.

The cone angle $\alpha$ of the annular cones 16, 17, likewise provided with air passage orifices 13, is about 30°.

The air passage orifices 13 have a diameter of about 0.1–0.5 mm and a distance between them of about 2 cm.

The entrance into the size wetting zone 12 is surrounded by a ring 22 with controlled automatic injection devices, not illustrated in any more detail, the size nozzles 23 of which project preferably perpendicularly through the upstream annular cone 16 into the interior of the inner pipe 14. The size nozzles 23 are preferably flat-jet nozzles with a maximum injection angle $\beta$ of about 90°.

What is claimed is:

1. A system for the production and preparation of fibers prior to their hot-pressing to form fiberboards, comprising a refiner (1) for the milling of, chips to form fibers which then pass by steam or air pressure through a blow line (2), a tubular dryer (3), a first separator (4), a sizing device (9) and a second separator (6) into a fiber bunker preceding a spreading machine or directly into a spreading machine, the sizing device (9) being integrated into a connecting pipeline (5) to the second separator (6) and comprising a size wetting zone (12) which extends over a portion of this connecting pipeline (5) and comprises an inner pipe (14) which is provided with air passage orifices (13) and has size nozzles (23) projecting into it and a flow cross section enlarged in relation to the connecting pipeline (5) and which is surrounded by an outer pipe (15) which, with the inner pipe (14), encloses an interspace having at least one air connection, characterized by the following features:

a) a fiber outlet of the first separator (4) is connected to the second separator (6) via said connecting pipeline (5), into which a blower (7) is connected upstream of the sizing device (9);

b) the inner pipe (14) is designed cylindrically, the increase in its flow cross section taking place upstream of the size wetting zone (12) and a reduction in its flow cross section taking place downstream of the size wetting zone (12) from and to the initial diameter of the connecting pipeline (5) respectively, in each case via an annular cone (16, 17);

c) an upstream annular cone (16), which, like a downstream annular cone (17), is provided with air passage orifices (13), is surrounded by a ring (22) with controlled automatic injection devices, the size nozzles (23) of which project through the upstream annular cone (16) into the inner pipe (14);

d) the outer pipe (15) concentrically surrounds the inner pipe (14) and with the latter defines an annular space (18) which is sealed off at its two ends and which has at least one compressed-air connection (20), from which compressed air is fed into the annular space (18) via annular compressed-air distributors (19) concentrically surrounding the outer pipe (15);

e) the air passage orifices (13) of the inner pipe (14) have a diameter of about 0.1–0.5 mm.

2. The system as claimed in claim 1, characterized in that the blower (7) connected into the connecting pipeline (5) has an intake connection piece for conditioned air (8).

3. The system as claimed in claim 1, characterized in that the length of the size wetting zone corresponds approximately to 5 to 10 times the pipeline diameter.

4. The system as claimed in claim 1, characterized in that the distance between the air passage orifices is about 2 cm.

5. The system as claimed in claim 1, characterized in that the flow cross section of the inner pipe is about 20% to 80% larger than that of the connecting pipeline.

6. The system as claimed in claim 1, characterized in that a cone angle ($\alpha$) of the annular cones is about 30°.

7. The system as claimed claim 1, characterized in that the fed-in compressed air has a pressure of approximately 2 bar.

8. The system as claimed in claim 1, characterized in that the size nozzles are flat-jet nozzles with a maximum injection angle ($\beta$) of about 90°.

9. The system as claimed in claim 1, characterized in that at least one further compressed-air connection issuing into said annular space is provided at about half the length of the size wetting zone.

10. The system as claimed in claim 1, characterized in that the sizing device is integrated in a steeply upward-running portion of the connecting pipeline.

* * * * *